US011830693B2

(12) United States Patent
Adkins et al.

(10) Patent No.: US 11,830,693 B2
(45) Date of Patent: Nov. 28, 2023

(54) PREDICTING ZERO-CROSSINGS FOR POINT-ON-WAVE (POW) SWITCHING TECHNIQUES

(71) Applicant: Rockwell Automation Technologies, Inc., Mayfield Heights, OH (US)

(72) Inventors: Kyle B. Adkins, Oak Creek, WI (US); Andrew E. Carlson, Franklin, WI (US); David M. Messersmith, Kenosha, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 233 days.

(21) Appl. No.: 17/485,748

(22) Filed: Sep. 27, 2021

(65) Prior Publication Data

US 2023/0102770 A1 Mar. 30, 2023

(51) Int. Cl.

| | |
|---|---|
| ***H01H 47/22*** | (2006.01) |
| ***H01H 50/44*** | (2006.01) |
| ***H01H 50/36*** | (2006.01) |
| ***H01H 47/00*** | (2006.01) |

(52) U.S. Cl.

CPC ..... *H01H 47/22* (2013.01); *H01H 47/002* (2013.01); *H01H 50/36* (2013.01); *H01H 50/44* (2013.01)

(58) Field of Classification Search

CPC ..... H01H 47/22; H01H 47/002; H01H 50/36; H01H 50/44; H01H 33/006; H01H 9/563; H01H 2009/566; H01H 47/02

See application file for complete search history.

(56) References Cited

U.S. PATENT DOCUMENTS

| | | | |
|---|---|---|---|
| 6,172,863 | B1 | 1/2001 | Ito et al. |
| 10,424,449 | B2 | 9/2019 | Nishio |
| 2003/0235017 | A1 | 12/2003 | Liu |

(Continued)

FOREIGN PATENT DOCUMENTS

| | | | |
|---|---|---|---|
| CN | 110729155 | A | 1/2020 |
| EP | 0575792 | A1 | 12/1993 |
| EP | 2237296 | A2 | 10/2010 |

OTHER PUBLICATIONS

Extended European Search Report for Application No. 22198004.8 dated Jan. 24, 2023, 7 pages.

*Primary Examiner* — Giovanni Astacio-Oquendo
*Assistant Examiner* — Zannatul Ferdous
(74) *Attorney, Agent, or Firm* — Fletcher Yoder, P.C.

(57) ABSTRACT

A method may include receiving a command to move one or more armatures of a switching device from a first position that electrically couples a first contact to a second contact to a second position that electrically uncouples the first contact from the second contact. The method may also include selecting a current zero-crossing point along an electric waveform indicative of a change in current through the first contact and the second contact as a synchronization point, determining a predicted current zero-crossing point by adding a period measurement associated with a previously detected current zero-crossing point or a previously detected line-to-line crossing point in the electric waveform to the synchronization point, and transmitting a command to the switching device to move the armatures from the first position to the second position before or at the predicted current zero-crossing point.

20 Claims, 10 Drawing Sheets

(56) References Cited

U.S. PATENT DOCUMENTS

| | | | | |
|---|---|---|---|---|
| 2004/0169987 | A1* | 9/2004 | Green | H01H 9/56 361/160 |
| 2011/0141647 | A1* | 6/2011 | Garcia | H01H 23/145 361/166 |
| 2016/0131712 | A1 | 5/2016 | Bock et al. | |
| 2019/0044460 | A1* | 2/2019 | Jaap | H02P 1/26 |

* cited by examiner

PREDICTING ZERO-CROSSINGS FOR POINT-ON-WAVE (POW) SWITCHING TECHNIQUES

BACKGROUND

The present disclosure relates generally to switching devices. More specifically, the present disclosure is related to improved operation and configuration of the switching devices.

Switching devices are generally used throughout industrial, commercial, material handling, process and manufacturing settings, to mention only a few. As used herein, a "switching device" is generally intended to describe any electromechanical switching device, such as mechanical switching devices (e.g., a contact, a relay, air break devices, and controlled atmosphere devices) or solid-state devices (e.g., a silicon-controlled rectifier (SCR)). More specifically, switching devices generally open to disconnect electric power from a load and close to connect electric power to the load. For example, switching devices may connect and disconnect three-phase electric power to an electric motor. As the switching devices open or close, electric power may be discharged as an electric arc and/or cause current oscillations to be supplied to the load, which may result in torque oscillations. To facilitate reducing the duration and/or magnitude of such effects, the switching devices may be opened and/or closed at specific points on the electric power waveform. Such carefully timed switching is sometimes referred to as "point on wave" or "POW" switching. However, depending on the electric motor, a power factor associated with the electric motor may change based on the load current. For example, the power factor may range from five percent to ninety percent based on the load current. As the power factor of the electric motor changes, the timing of the POW switching along the electric power waveform may deviate until a steady state of the load current is reached. Accordingly, it may be beneficial to employ improved systems and methods for POW switching to facilitate opening or closing of the switching device at a specific point on the electric power waveform.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

BRIEF DESCRIPTION

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a system may include a switching device that has one or more armatures configured to move between a first position that electrically couples a first contact and a second position that electrically uncouples the first contact from the second contact. The switching device may also have a relay coil that may receive a voltage that magnetizes the relay coil, thereby causing the armature to move from the first position to the second position. The system may also include a control system that may perform operations that include receiving a command to move the one or more armatures from the first position to the second position and selecting a current zero-crossing point along an electric waveform as a synchronization point. The electric waveform is indicative of a change in current through the first contact and the second contact. The operations may also include determining a predicted current zero-crossing point by adding a period measurement associated with a previously detected current zero-crossing point or a previously detected current line-to-line crossing point in the electric waveform to the synchronization point and transmitting a command to the switching device to move the one or more armatures from the first position to the second position before or at the predicted current zero-crossing point.

In another embodiment, a non-transitory, computer-readable storage medium may include instructions that, when executed by one or more processors, cause the processors to perform operations that include receiving a command to move one or more armatures of a switching device from a first position that electrically couples a first contact to a second contact to a second position that electrically uncouples the first contact from the second contact. The operations may also include selecting a current zero-crossing point along an electric waveform indicative of a change in current through the first contact and the second contact as a synchronization point, determining a predicted current zero-crossing point by adding a period measurement associated with a previously detected current zero-crossing point or a previously detected line-to-line crossing point in the electric waveform to the synchronization point, and transmitting a command to the switching device to move the armatures from the first position to the second position before or at the predicted current zero-crossing point.

In yet another embodiment, a method may include receiving a command to move one or more armatures of a switching device from a first position that electrically couples a first contact to a second contact to a second position that electrically uncouples the first contact from the second contact. The method may also include selecting a current zero-crossing point along an electric waveform indicative of a change in current through the first contact and the second contact as a synchronization point, determining a predicted current zero-crossing point by adding a period measurement associated with a previously detected current zero-crossing point or a previously detected line-to-line crossing point in the electric waveform to the synchronization point, and transmitting a command to the switching device to move the armatures from the first position to the second position before or at the predicted zero-crossing point.

DRAWINGS

These and other features, aspects, and advantages of the present invention will become better understood when the following detailed description is read with reference to the accompanying drawings in which like characters represent like parts throughout the drawings, wherein.

Figure 10:
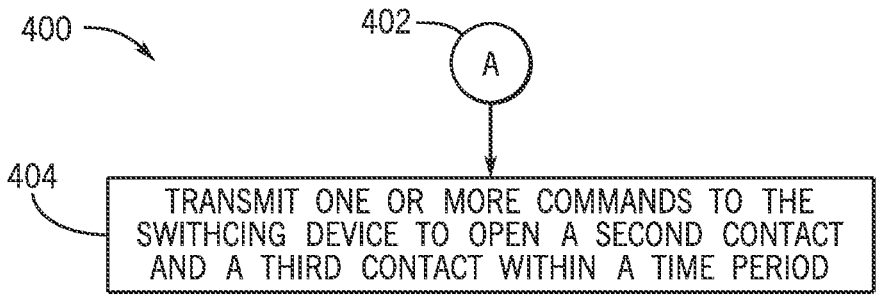
Figure 11:
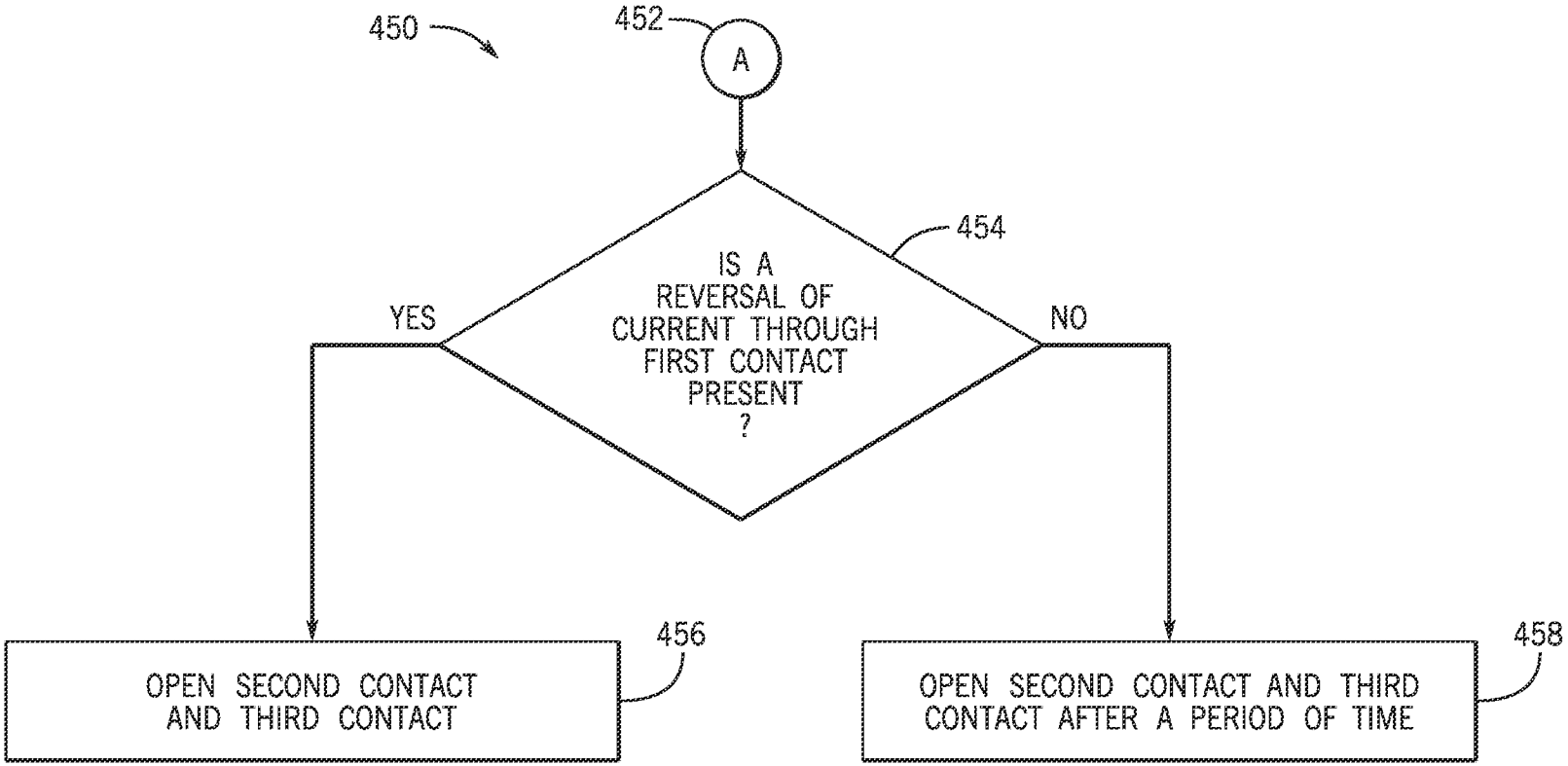

FIG. 10 is a flowchart of a process for opening respective contacts associated with a second phase of the multi-phase signal and a third phase of the multi-phase signal after a contact associated with a first phase of the multi-phase signal has been opened, in accordance with an embodiment; and FIG. 11 is a flowchart of process for determining whether a reversal of current is present after the first contact in a multi-phase system has opened and determining an appropriate timing to open a second contact and a third contact in the multi-phase system based on the determination, in accordance with an embodiment.

DETAILED DESCRIPTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements. One or more specific embodiments of the present embodiments described herein will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

As described above, switching devices are used in various implementations, such as industrial, commercial, material handling, manufacturing, power conversion, and/or power distribution systems, to connect and/or disconnect electric power from a load, such as an electric motor. As the switching devices open or close, electric power may be discharged as an electric arc and/or cause current oscillations to be supplied to the load, which may result in torque oscillations. To facilitate reducing the duration and/or magnitude of such effects, POW switching may be utilized to open and/or close the switching devices at specific points on an electric power waveform. However, multi-phase motors may have a power factor that changes based on the load current. That is, under transient load conditions, the power factor of the electric motor changes and the expected timing of a zero crossing for the POW switching to occur along the electric power waveform may deviate as compared to when a steady state load current is present.

Accordingly, embodiments of the present disclosure provide techniques for predicting future zero crossing points for opening a switching device in coordination with a specific point on a multi-phase signal based on historical zero crossing time measurements. For example, to reduce magnitude and/or duration of arcing, the switching device may open based on a predicted current zero-crossing of a multi-phase signal conducting through the respective switching device. As used herein, a "current zero-crossing" is intended to describe an instant or time in which the current conducted by the switching device is zero. Accordingly, by opening the switching device at or before a current zero-crossing, the duration of arcing is minimal since the conducted current is zero or close to zero.

However, when a load is applied to an electric motor, the timing of a current zero-crossing of a phase signal (e.g., analog phase signal) may shift inwards (e.g., the rate of the current zero-crossing may increase) in comparison to the timing of a current zero-crossing of the phase signal during a steady state of the load. Alternatively, when a load is decreased for an electric motor, the timing of a current zero-crossing of the phase signal may shift outwards or to lead (e.g., the rate of the current zero-crossing may decrease) the timing of a current zero-crossing of the phase signal during a steady state of the load. Thus, embodiments of the present disclosure are directed to more accurately predicting the timing of a current zero-crossing of the phase signal for an electric motor operating under transient load conditions based on historical current zero-cross data and/or historical current line-to-line data.

That is, a control system associated with an electric motor may continuously measure and store respective period measurements from each current zero-crossing point of a first phase signal to the next corresponding current zero-crossing point of the same phase signal, respective period measurements from each current line-to-line crossing point between phases of a related multi-phase signal (e.g., including the first phase signal mentioned above), or both. After receiving a command to open the switching device, the control system may select a current zero-crossing point of the first phase signal of the multi-phase signal as a synchronization point. That is, the control system may use the first detected current zero-crossing point of the first phase signal to determine an expected time of a predicted current zero-crossing point along the same phase signal. The expected time of the predicted current zero-crossing point may then be targeted to open the switching device.

After selecting a current zero-crossing point of the first phase signal as the synchronization point, the control system may optimize the expected time of the predicted current zero-crossing point based on historical period measurements of the previously measured current zero crossings for the phase signal. For instance, the control system may determine the expected time of the predicted current zero-crossing point by determining the most recent period measurement of the first phase signal based on the one or more recent current zero-crossing points measured for the first phase signal and adding the most recent period measurement to the synchronization point. Alternatively, the control system may determine the expected time of the predicted current zero-crossing point by determining the most recent period measurement for one or more current line-to-line crossing points of two-phase signals (e.g., of the multi-phase signals) and adding the most recent period measurement to the synchronization point.

Thereafter, for each current zero-crossing point of the first phase signal, each current line-to-line crossing point between two different phase signals of the multi-phase signal, or both, the control system may measure a respective period measurement and update the expected time of the predicted current zero-crossing point based on the respective period measurement. For instance, if the respective period measurement is greater than the period measurement used to determine the expected time of the predicted current zero-crossing point, the expected time of the predicted current zero-crossing point may shift forward in time from the synchronization point. Alternatively, if the respective period measurement is less than the period measurement used to determine the predicted current zero-crossing point, the expected time of the predicted current zero-crossing point may shift backwards in time toward the synchronization point. In this way, the control system may continuously evaluate each current zero-crossing point of the first phase signal, each current line-to-line crossing point between two different phase signals of the multi-phase signal, or both until the expected time of the predicted current zero-crossing point along the multi-phase signal in the determination of the expected time of the predicted current zero-crossing point. As a result, the control system may continuously optimize or adjust the expected time of the predicted current zero-crossing point at or before which to open or break the switching device based on any historical deviations in the multi-phase signal from steady state.

In some embodiments, after determining the expected time of the predicted current zero-crossing point for the first phase of the multi-phase signal, the control system may open respective switching devices associated with the second phase and the third phase. For instance, after the switching device associated with the first phase of the multi-phase signal opens at or before the expected time of the predicted current zero-crossing point, the control system may open the respective switching devices associated with the second phase and the third phase within a particular period of time (e.g., within a time period corresponding to ninety degrees of the multi-phase signal after the opening of the switching device associated with the first phase).

Further, under certain operating conditions, the switching device associated with the first phase may open after the current zero-crossing, thereby causing arcing. If the timing associated with opening the switching devices associated with the second phase and/or the third phase is not adjusted, the switching devices associated with the second phase and/or the third phase may also open after the current zero-crossing, thereby causing further arcing. Accordingly, in certain embodiments, if the switching device associated with the first phase does not open before or at a current zero-crossing, the control system may adjust the timing associated with opening the switching devices associated with the second phase and/or third phase to minimize the arc time. Additional details related to predicting the zero-crossing times for phase signals will be discussed below with reference to FIGS. 1-11.

Figure 1:
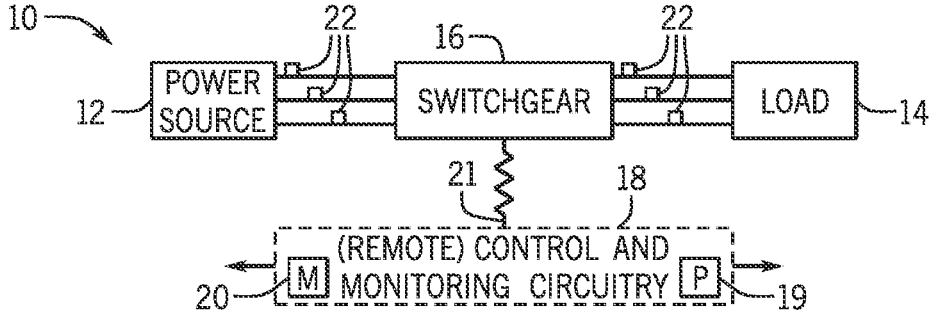
FIG. 1 is a diagrammatical representation of a set of switching devices to provide power to an electrical load, in accordance with an embodiment.

By way of introduction, FIG. 1 depicts a system 10 that includes a power source 12, a load 14, and switchgear 16, which includes one or more switching devices that may be controlled using the techniques described herein. In the depicted embodiments, the switchgear 16 may selectively connect and/or disconnect three-phase electric power output by the power source 12 to the load 14, which may be an electric motor or any other powered device. In this manner, electrical power flows from the power source 12 to the load 14. For example, switching devices in the switchgear 16 may close to connect electric power to the load 14. On the other hand, the switching devices in the switchgear 16 may open to disconnect electric power from the load 14. In some embodiments, the power source 12 may be an electrical grid.

It should be noted that the three-phase implementation described herein is not intended to be limiting. More specifically, certain aspects of the disclosed techniques may be employed on single-phase circuitry and/or for applications other than powering an electric motor. Additionally, it should be noted that in some embodiments, energy may flow from the power source 12 to the load 14. In other embodiments, energy may flow from the load 14 to the power source 12 (e.g., a wind turbine or another generator). More specifically, in some embodiments, energy flow from the load 14 to the power source 12 may transiently occur, for example, when overhauling a motor.

In some embodiments, operation of the switchgear 16 (e.g., opening or closing of switching devices) may be controlled by control and monitoring circuitry 18. More specifically, the control and monitoring circuitry 18 may instruct the switchgear 18 to connect or disconnect electric power. Accordingly, the control and monitoring circuitry 18 may include one or more processors 19 and memory 20. More specifically, as will be described in more detail below, the memory 20 may be a tangible, non-transitory, computer-readable medium that stores instructions, which when executed by the one or more processors 19, performs various processes described herein. It would be noted that "non-transitory" merely indicates that the media is tangible and not a signal. Many different algorithms and control strategies may be stored in the memory and implemented by the processor 19, and these will typically depend upon the nature of the load, the anticipated mechanical and electrical behavior of the load, the particular implementation, behavior of the switching devices, and so forth.

Additionally, as depicted, the control and monitoring circuitry 18 may be remote from the switchgear 16. In other words, the control and monitoring circuity 18 may be communicatively coupled to the switchgear 16 via a network 21. In some embodiments, the network 21 may utilize various communication protocols such as DeviceNet, Profibus, Modbus, and Ethernet, to mention only a few. For example, to transmit signals, the control and monitoring circuitry 18 may utilize the network 21 to send close and/or open instructions to the switchgear 16. The network 21 may also communicatively couple the control and monitoring circuitry 18 to other parts of the system 10, such as other control circuitry or a human-machine-interface (not separately depicted). Additionally, the control and monitoring circuitry 18 may be included in the switchgear 16 or directly coupled to the switchgear 16, for example, via a serial cable.

Furthermore, as depicted, the electric power input to the switchgear 16 and output from the switchgear 16 may be monitored by sensors 22. More specifically, the sensors 22 may monitor (e.g., measure) the characteristics (e.g., voltage or current) of the electric power. Accordingly, the sensors 22 may include voltage sensors and current sensors. These sensors may alternatively be modeled or calculated values determined based on other measurements (e.g., virtual sensors). Many other sensors and input devices may be used, depending upon the parameters available and the application. Additionally, the characteristics of the electric power measured by the sensors 22 may be communicated to the control and monitoring circuitry 18 and used as the basis for algorithmic computation and generation of waveforms (e.g., voltage waveforms or current waveforms) that depict the electric power. More specifically, the waveforms that are generated based on input from the sensors 22 monitoring the electric power input into the switchgear 16 may be used to define the control of the switching devices, for example, by reducing electrical arcing when the switching devices open or close. The waveforms that are generated based on input from the sensors 22 monitoring the electric power output from the switchgear 16 and supplied to the load 14 may be used in a feedback loop to, for example, monitor conditions of the load 14.

Figure 2:
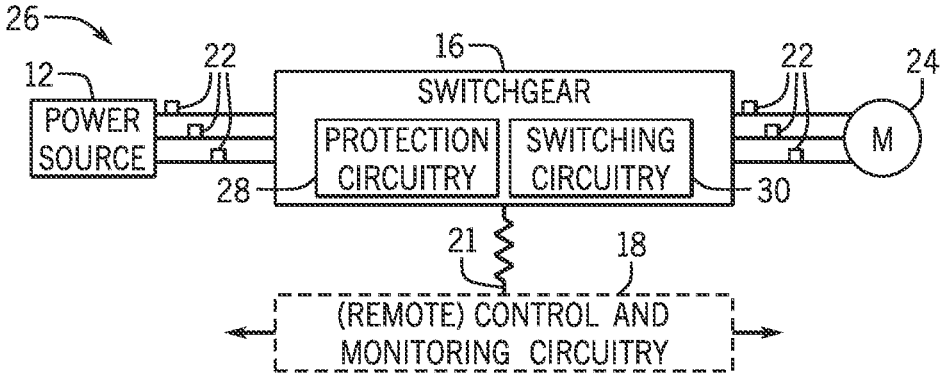
FIG. 2 is a similar diagrammatical representation of a set of switching devices to provide power to an electrical motor, in accordance with an embodiment.

As described above, the switchgear 16 may connect and/or disconnect electric power from various types of loads 14, such as an electric motor 24 included in the motor system 26 depicted in FIG. 2. As depicted, the switchgear 16 may connect and/or disconnect the power source 12 from the electric motor 24, such as during startup and shutdown. Additionally, as depicted, the switchgear 16 will typically include or function with protection circuitry 28 and the actual switching circuitry 30 that makes and breaks connections between the power source and the motor windings. More specifically, the protection circuitry 28 may include fuses and/or circuit breakers, and the switching circuitry 30 will typically include relays, contacts, and/or solid-state switches (e.g., silicon controlled rectifiers (SCRs), metal-oxide-semiconductor field-effect transistors (MOSFETs), insulated-gate bipolar transistors (IGBTs), and/or gate turn-off thyristor (GTOs)), such as within specific types of assembled equipment (e.g., motor starters).

More specifically, the switching devices included in the protection circuitry 28 may disconnect the power source 12 from the electric motor 24 when an overload, a short circuit condition, or any other unwanted condition is detected. Such control may be based on the un-instructed operation of the device (e.g., due to heating, detection of excessive current, and/or internal fault), or the control and monitoring circuitry 18 may instruct the switching devices (e.g., contacts or relays) included in the switching circuitry 30 to open or close. For example. the switching circuitry 30 may include one (e.g., a three-phase contact) or more contacts (e.g., three or more single-pole, single current-carrying path switching devices).

Accordingly, to start the electric motor 24, the control and monitoring circuitry 18 may instruct the one or more contacts in the switching circuitry 30 to close individually, together, or in a sequential manner. On the other hand, to stop the electric motor 24, the control and monitoring circuitry 18 may instruct the one or more contacts in the switching circuitry 30 to open individually, together, or in a sequential manner. When the one or more contacts are closed, electric power from the power source 12 is connected to the electric motor 24 or adjusted and, when the one or more contacts are open, the electric power is removed from the electric motor 24 or adjusted. Other circuits in the system may provide controlled waveforms that regulate operation of the motor (e.g., motor drives, automation controllers, etc.), such as based upon movement of articles or manufacture, pressures, temperatures, and so forth. Such control may be based on varying the frequency of power waveforms to produce a controlled speed of the motor.

In some embodiments, the control and monitoring circuitry 18 may determine when to open or close the one or more contacts based at least in part on the characteristics of the electric power (e.g., voltage, current, or frequency) measured by the sensors 22. Additionally, the control and monitoring circuitry 18 may receive an instruction to open or close the one or more contacts in the switching circuitry 30 from another part of the motor system 26, for example, via the network 21.

The control and monitoring circuitry 18 may include a programmable logic controller (PLC) that locally (or remotely) controls operation of the switchgear 16. For example, the control and monitoring circuitry 18 may instruct the switchgear 16 to connect or disconnect electric power. Accordingly, the control and monitoring circuitry 18 may include a tangible non-transitory computer-readable medium on which instructions are stored. As will be described in more detail below, the computer-readable instructions may be configured to perform various processes described when executed by one or more processors. In some embodiments, the control and monitoring circuitry 18 may also be included within the switchgear 16.

Moreover, sensors 22 may be included throughout the machine or process system 34. More specifically, as depicted, sensors 22 may monitor electric power supplied to the switchgear 16, electric power supplied to the motor controller/drive 32, and electric power supplied to the electric motor 24. For example, in a manufacturing process, sensors 22 may be included to measure speeds, torques, flow rates, pressures, the presence of items and components, or any other relevant parameters. As described above, the sensors 22 may feedback information gathered regarding the switchgear 16 and/or the motor 24 to the control and monitoring circuitry 18 in a feedback loop. Additionally, the sensors 22 may provide the gathered information directly to the remote control and monitoring circuitry 18, for example, via the network 21.

The electric motor 24 may convert electric power to provide mechanical power. To help illustrate, an electric motor 24 may provide mechanical power to various devices. For example, the electric motor 24 may provide mechanical power to a fan, a conveyer belt, a pump, a chiller system, and various other types of loads that may benefit from the advances proposed.

As discussed in the above examples, the switchgear 16 may control operation of a load (e.g., electric motor 24) by controlling electric power supplied to the load 14. For example, switching devices (e.g., contacts) in the switchgear 16 may be closed to supply electric power to the load 14 an opened to disconnect electric power from the load 14.

Figure 3:
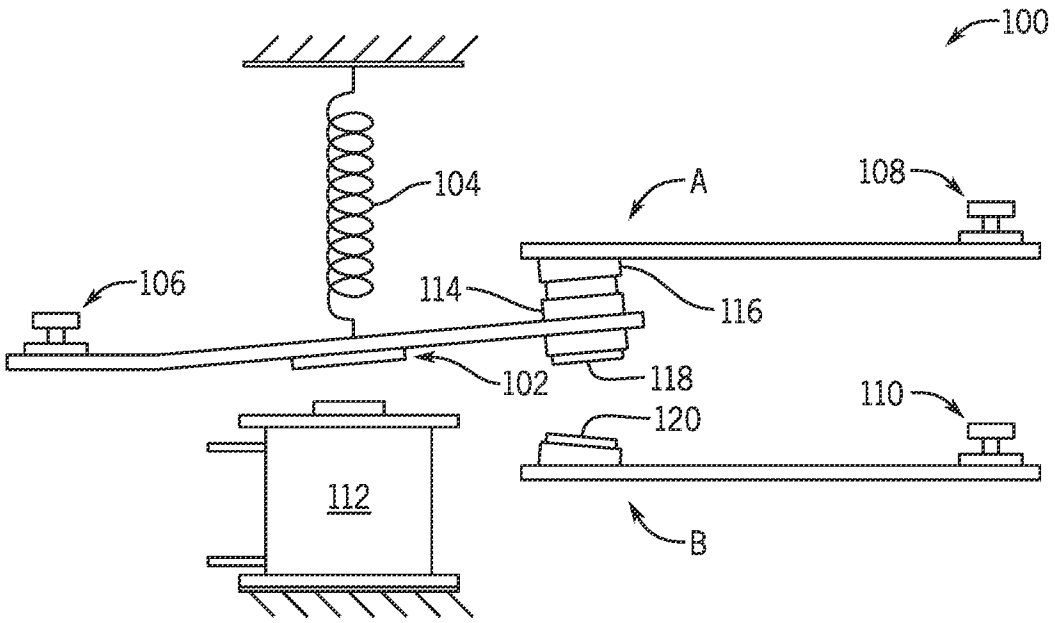
FIG. 3 is a system view of an example single-pole, single current-carrying path relay device, in accordance with an embodiment.

By way of example, the switching device may include a relay device 100 that is composed of components illustrated in FIG. 3, some of which correspond to the components of the switching device described above. As shown in FIG. 3, the relay device 100 may include an armature 102 that is coupled to a spring 104. The armature 102 may have a common contact 106 that may be coupled to a part of an electrical circuit. The armature 102 may electrically couple the common contact 106 to a contact 108 or to a contact 110 depending on a state (e.g., energized) of the relay device 100. For example, when a relay coil 112 of the relay device 100 is not energized or does not receive voltage form a driving circuit, the armature 102 is positioned such that the common contact 106 and the contact 108 are electrically coupled to each other. When the relay coil 112 receives a driving voltage, the relay coil 112 magnetizes and attracts the armature 102 to itself, thereby connecting the contract 110 to the common contact 106.

The electrical connections between the common contact 106 and the contacts 108 and 110 are made via contacts 114 and 116 and contacts 118 and 120, respectively. Over time, as the contacts 114 and 116 and the contacts 118 and 120 strike against each other, the conductive material of the contacts 114, 116, 118, and 120 may begin to wear.

Moreover, the relay coil 112 may include a core that minimizes a core flux during the operation of the relay device 100. That is, as the armature 102 moves between connecting to the contact 108 and the contact 110, and vice-versa, a magnetic flux may be generated in a core of the relay coil 112 and/or the armature 102. This magnetic flux may be related to the core flux of the relay coil 112 and may change over time as the relay device operates.

As discussed in the above examples, the switchgear 16 may control operation of a load 14 (e.g., electric motor 24) by controlling electric power supplied to the load 14. For example, switching devices (e.g., contacts) in the switchgear 16 may be closed to supply electric power to the load 14 and opened to disconnect electric power form the load 14. However, as discussed above, opening (e.g., breaking) and closing (e.g., making) the switching devices may discharge electric power in the form of electric arcing, thereby causing current oscillations to be supplied to the load 14, and/or cause the load 14 to produce torque oscillations.

Accordingly, embodiments of the present disclosure provide techniques for opening a switching device in coordination with a specific point on an electric power waveform. For example, to reduce magnitude and/or duration of arcing, the switching device may open based on a predicted current zero-crossing of a multi-phase signal conducting through the respective switching device. As used herein, a "current zero-crossing" is intended to describe when the current conducted by the switching device is zero. Accordingly, by opening before or at a current zero-crossing, the time of arcing is minimal since the conducted current is zero.

Although certain embodiments describe opening a switching device based on a predicted current zero-crossing, it should be understood that the switching devices may be controlled to open and close at any desired point on the waveform using the disclosed techniques. To facilitate opening and/or closing at a desired point on the waveform, one or more switching devices may be independently controlled to selectively connect and disconnect a phase of electric power to the load 14. In some embodiments, the one or more switching devices may be a multi-pole, multi-current carrying path switching device that controls connection of each phase with a separate pole. More specifically, the multi-pole, multi-current carrying path switching device may control each phase of electric power by movement of a common assembly under the influence of a single operation (e.g., an electromagnetic operator). Thus, in some embodiments, to facilitate independent control, each pole may be connected to the common assembly in an offset manner, thereby enabling movement of the common assembly to affect one or more of the poles differently.

In other embodiments, the one or more switching devices may include multiple single pole switching devices. As used herein, a "single pole switching device" is intended to differentiate from a multi-pole, multi-current-carrying path switching device in that each phase is controlled by movement of a separate assembly under influence of a separate operator. In some embodiments, the single pole switching device may be a single pole, multi-current carrying path switching device (e.g., multiple current carrying paths controlled by movement of a single operator) or a single-pole, single current-carrying path switching device, as described herein.

As described above, controlling the opening of the one or more switching devices may facilitate reducing the magnitude of in-rush current and/or current oscillations, which may strain the load 14, the power source 12, and/or other connected components. As such, the one or more switching devices may be controlled such that the switching devices open based at least in part on a predicted current zero-crossing (e.g., within a range slightly before to slightly after the predicted current zero crossing). However, a power factor associated with the electric motor may change based on the quantity of load current. For example, the timing of the POW switching along the electric power waveform may deviate when a steady state of the load current is not present.

Figure 4:
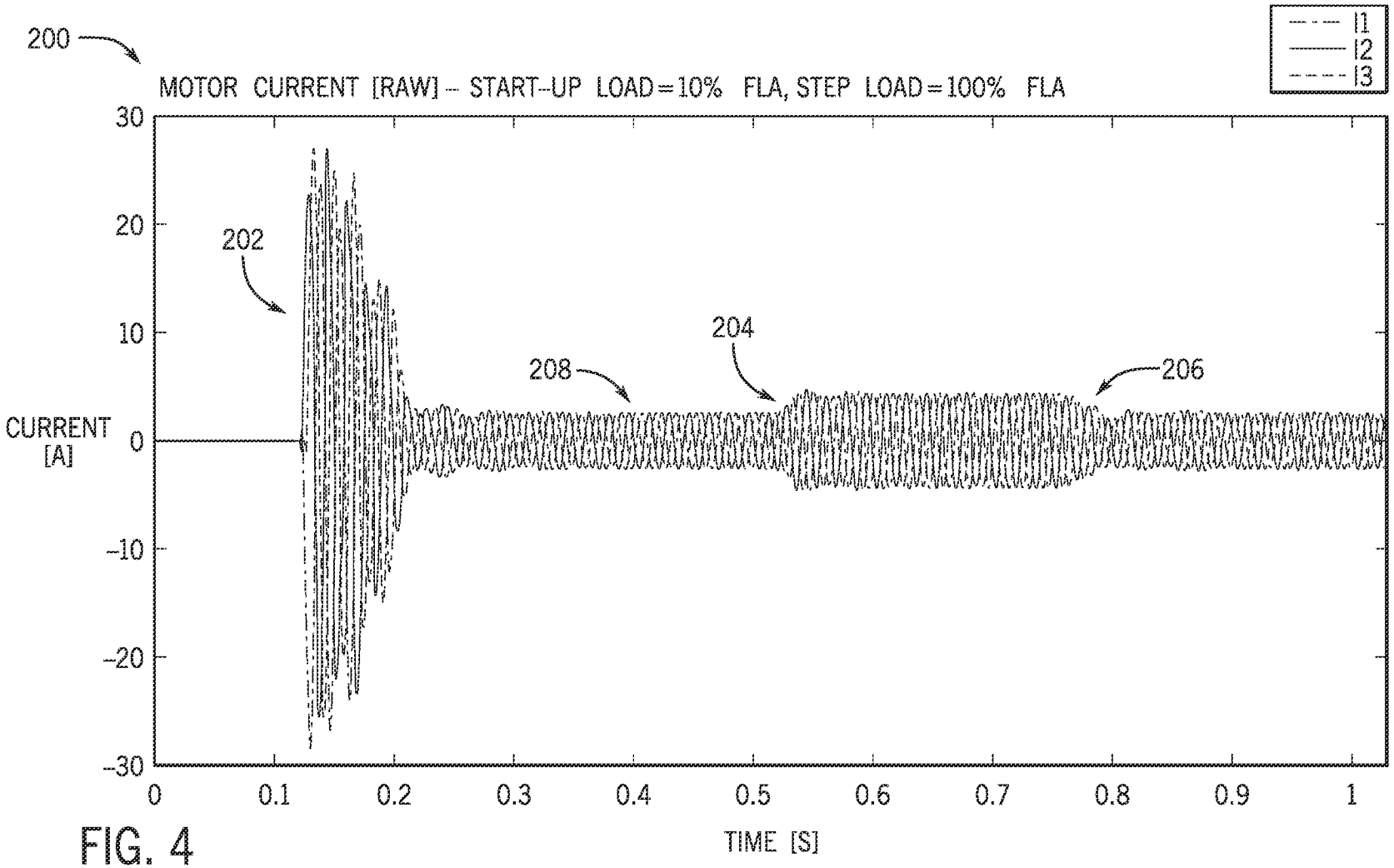
FIG. 4 is a current-time graph that depicts how current through contacts of a switching device may change based on the starting of a motor and a varying load current, in accordance with an embodiment.

With the foregoing in mind, FIG. 4 illustrates a current-time graph 200 associated with one or more switching devices that may independently control connection of each phase with a separate pole. The current-time graph 200 depicts how the current through contacts of the one or more switching devices changes over time during a start-up sequence of an electric motor 24 (e.g., during a first time period 202), when a load is applied to the electric motor 24 (e.g., during a second time period 204), and when a load is decreased on the electric motor 24 (e.g., during a third period 206). In particular, the current zero-crossing of each phase of the multi-phase signal deviates significantly during the start-up sequence of the electric motor 24 before the load current reaches a steady state (e.g., during a fourth period 208). Additionally, when a load is applied to the electric motor 24 and a load is decreased on the electric motor 24, each current zero-crossing point of each phase of the electric wave form may deviate from corresponding current zero-crossing points of each phase during a steady state of the load current.

Figure 5:
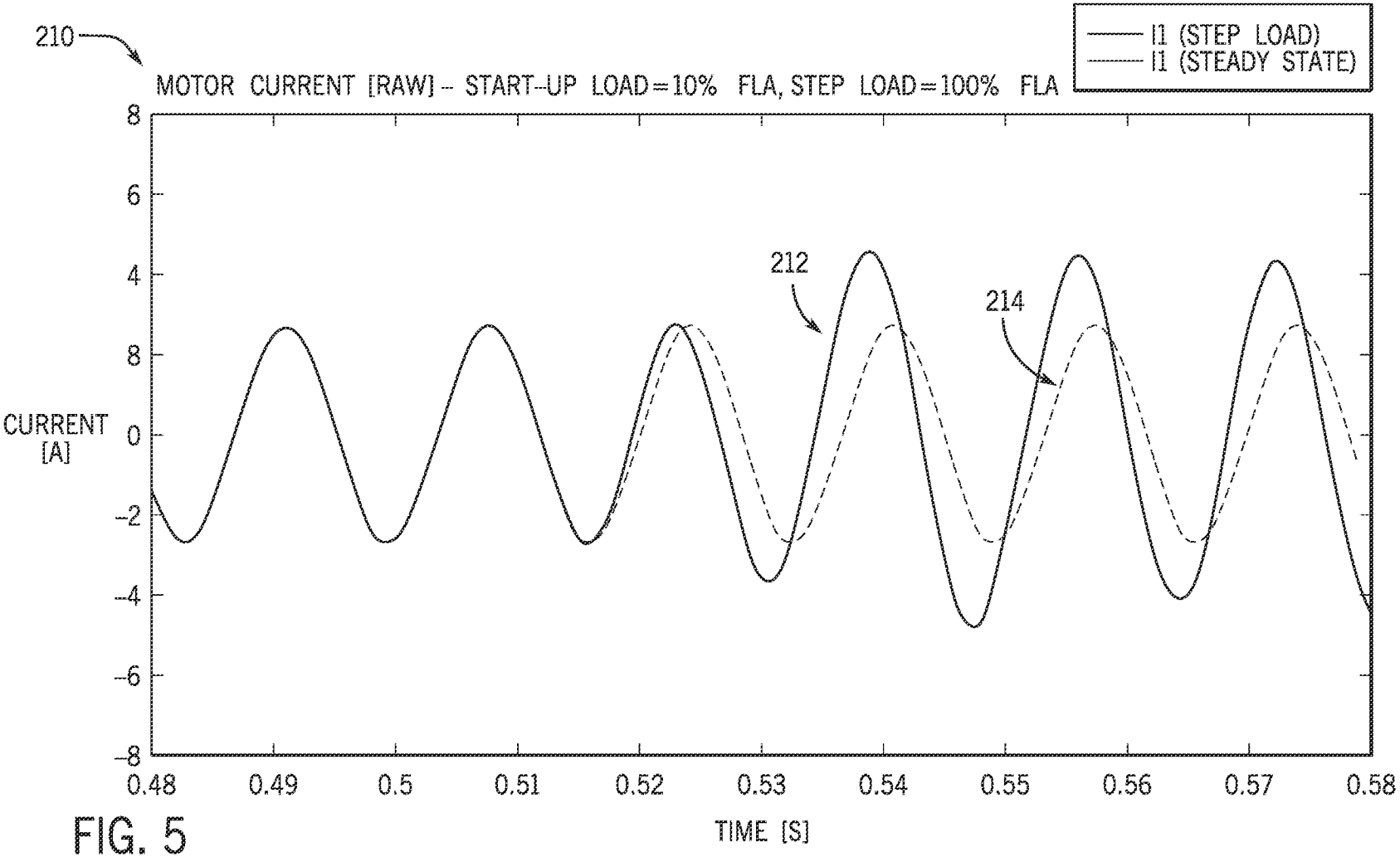
FIG. 5 is a current-time graph that depicts how the current through contacts of the switching device may change over time when a load is applied, in accordance with an embodiment.
Figure 6:
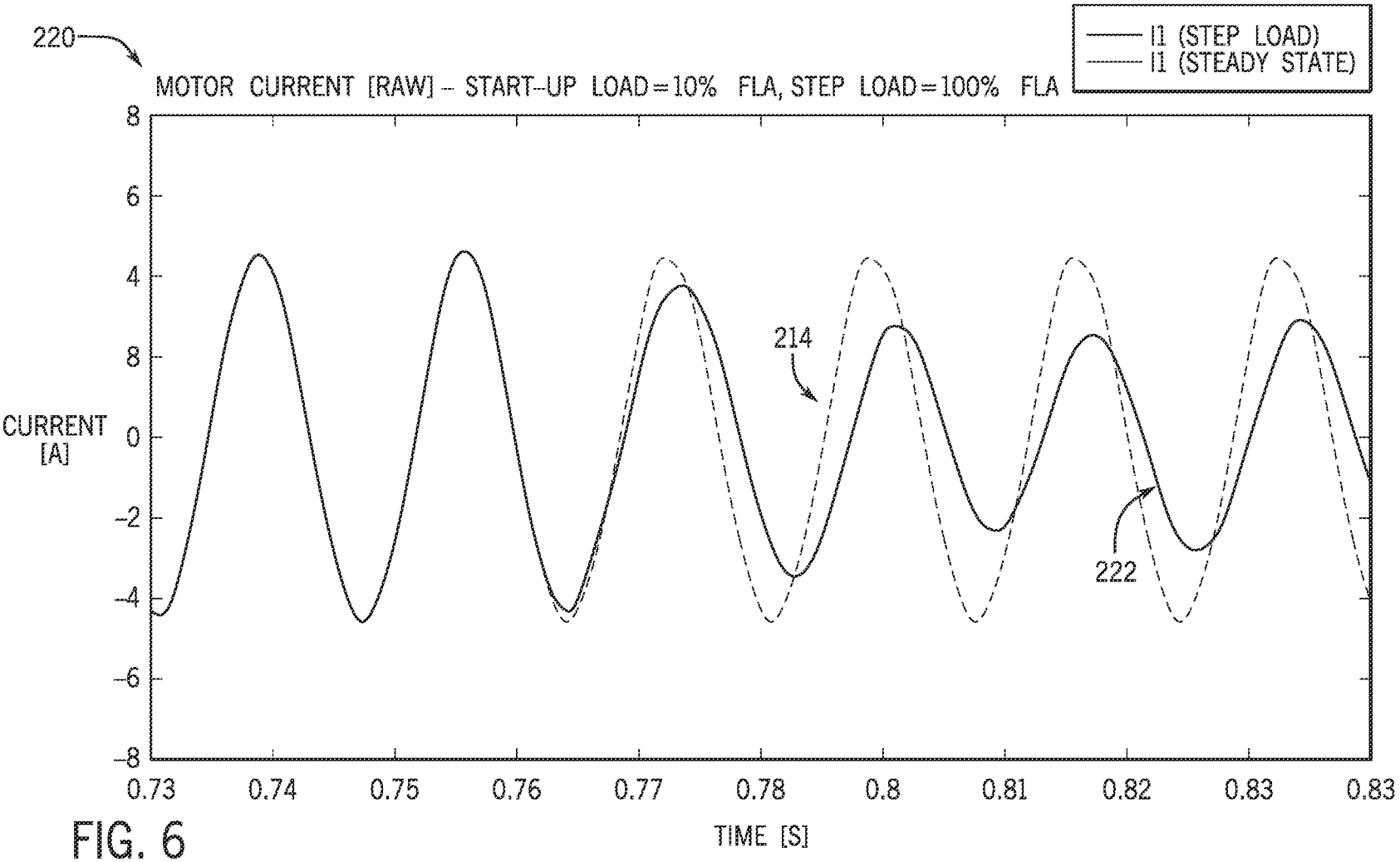
FIG. 6 is a current-time graph that depicts how the current through contacts of the switching device may change over time when a load is decreased, in accordance with an embodiment.

In particular, FIG. 5 illustrates a current-time graph 210 that depicts how the current within through contacts of one or more switching devices changes over time when a load is applied to an electric motor 24 (e.g., line 212) as compared to a steady state of the load current (e.g., line 214). Additionally, FIG. 6 illustrates a current-time graph 220 that depicts how the current through contacts of one or more switching devices changes over time when a load is decreased from an electric motor 24 (e.g., line 222) as compared to a steady state of the load current (e.g., line 214). As mentioned above, the timing of the current zero-crossing along the multi-phase signal when a load is applied to the electric motor 24 or a load is decreased from the electric motor 24 deviates from the timing of the current zero crossing along the multi-phase signal when the load current is experiencing a steady state. For example, when a load is applied to the electric motor 24, the timing of the current zero-crossing of the multi-phase signal may shift to lag (e.g., the rate of the current zero-crossing may increase) the timing of the current zero-crossing of the multi-phase signal during steady state of the load current. Additionally, when a load is decreased for an electric motor 24, the timing of the current zero-crossing of the multi-phase signal may shift to lead (e.g., the rate of the current zero-crossing may decrease) the timing of the current zero-crossing of the multi-phase signal during steady state of the load current.

Figure 7:
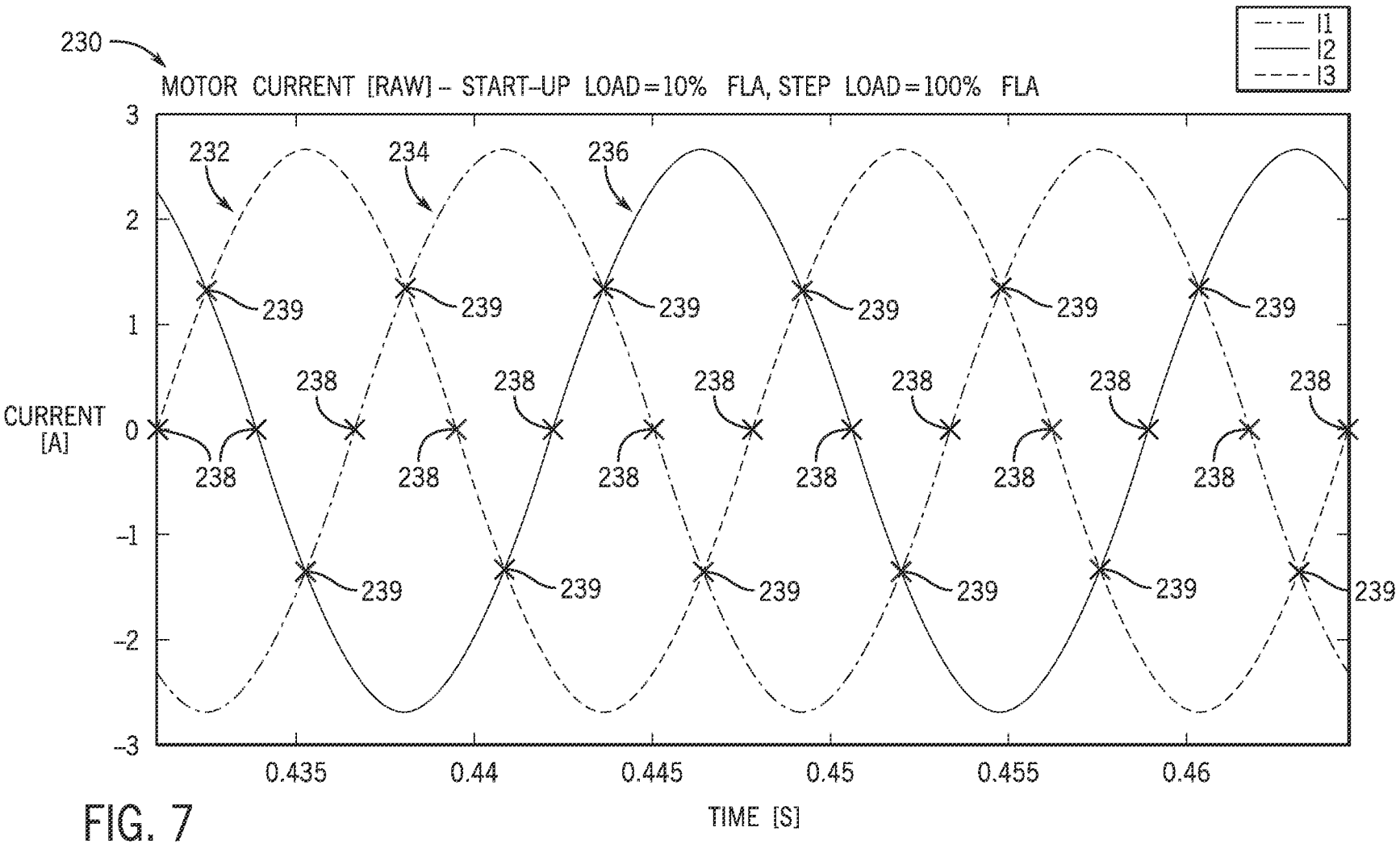
FIG. 7 is current-time graph that depicts how the current through contacts of the switching device may change over time with respect to a multi-phase system, in accordance with an embodiment.
Figure 8:
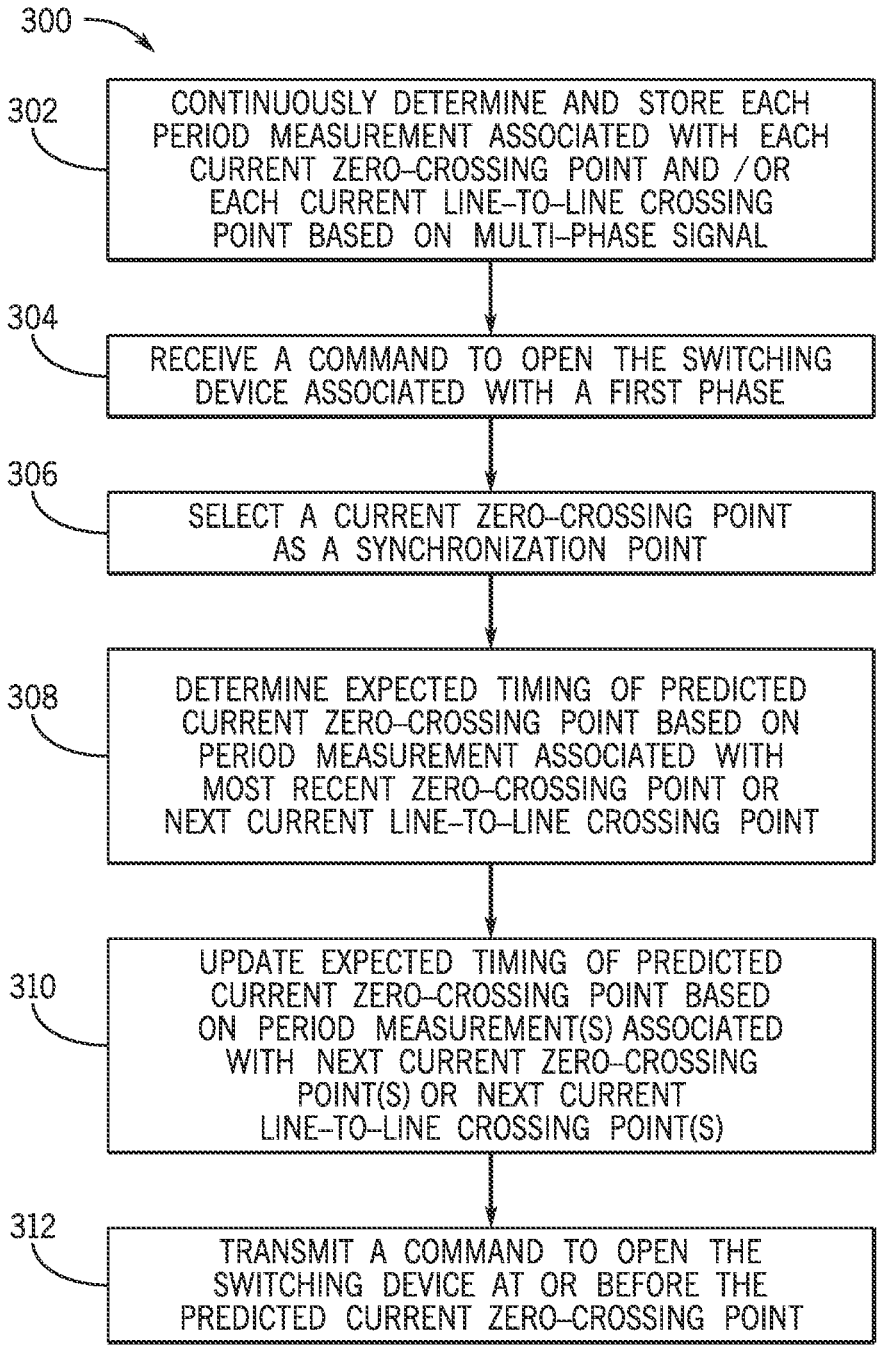
FIG. 8 is a flowchart of a process for predicting a timing of a current zero-crossing associated with a particular phase of a multi-phase signal associated with the multi-phase system based on historical current zero-crossing data and/or current line-to-line crossing data, in accordance with an embodiment.

Accordingly, embodiments of the present disclosure are directed to accurately predicting the timing of the current zero-crossing along the multi-phase signal to open a switching device associated with one or more phases based on historical current zero-cross data and/or current line-to-line data. For example, FIG. 8 illustrates a current-time graph 230 that depicts how the current of a first phase (e.g., line 232) associated with a first contact of a switching device, a second phase (e.g., line 234) associated with a second contact of the switching device, and a third phase (e.g., line 236) associated with a third contact of the switching device changes over time. FIG. 7 depicts a number of data points (e.g., data points 238) indicative of respective current zero-crossings along the first phase, the second phase, and the third phase of the multi-phase signal and a number of points (e.g., data points 239) indicative of respective crossings between two phases of the multi-phase signal (e.g., a current line-to-line crossing). Based on the current zero-crossing data points 238 and/or the current line-to-line crossing data points 239 leading up to a respective current zero-crossing along the multi-phase signal, a timing of a respective current zero-crossing along the multi-phase signal (e.g., a predicted current zero-crossing) may be predicted.

With the foregoing in mind, FIG. 8 is a flowchart of a process 300 for predicting the timing of a current zero-crossing associated with a particular phase of a multi-phase signal based on historical current zero-crossing data and/or current line-to-line crossing data. For example, the timing of the precited current zero-crossing may be employed to open a switching device (e.g., one or more contacts of the switching device) to minimize the magnitude and/or duration of arcing when opening the switching device. It should be noted that although the process 300 will be described as being performed by the control and monitoring circuitry 18, it should be understood that the process 300 may be performed by any suitable control system or computing device. In addition, although the process 300 is described in a particular order, it should be noted that the process 300 may be performed in any suitable order.

At block 302, the control and monitoring circuitry 18 may continuously determine and store respective period measurements from each detected current zero-crossing point and/or each detected current line-to-line crossing point based on a multi-phase waveform associated with a respective switching device. As described above, sensors 22 may continuously monitor characteristics (e.g., voltage or current) of the electric power input into the switching device. The control and monitoring circuitry 18 may receive sensor data from the sensors 22 associated with the monitored characteristics and continuously generate or update an electric waveform (e.g., a current waveform or a multi-phase signal) associated with the switching device based on the received sensor data. For example, the electric waveform may include one or more data points indicative of respective current zero-crossings associated with a first phase, a second phase, or a third phase of the multi-phase signal or one or more data points indicative of respective current line-to-line crossings between phases of the multi-phase signal. The control and monitoring circuitry 18 may continuously determine and store a respective period measurement associated with each current zero-crossing data point and each current line-to-line crossing data point. For example, the period measurement of a respective current zero-crossing data point may be equal to the time between the respective current zero-crossing data point and a previous current zero-crossing data point at a similar point along a particular phase signal. It should be understood that the control and monitoring circuitry 302 may continuously determine and store respective period measurements for each current zero-crossing data point and/or each current line-to-line crossing data point as the process 300 is performed. In certain embodiments, the control and monitoring circuitry 18 may filter one or more period measurements to remove noise after determining the period measurements.

Figure 9:
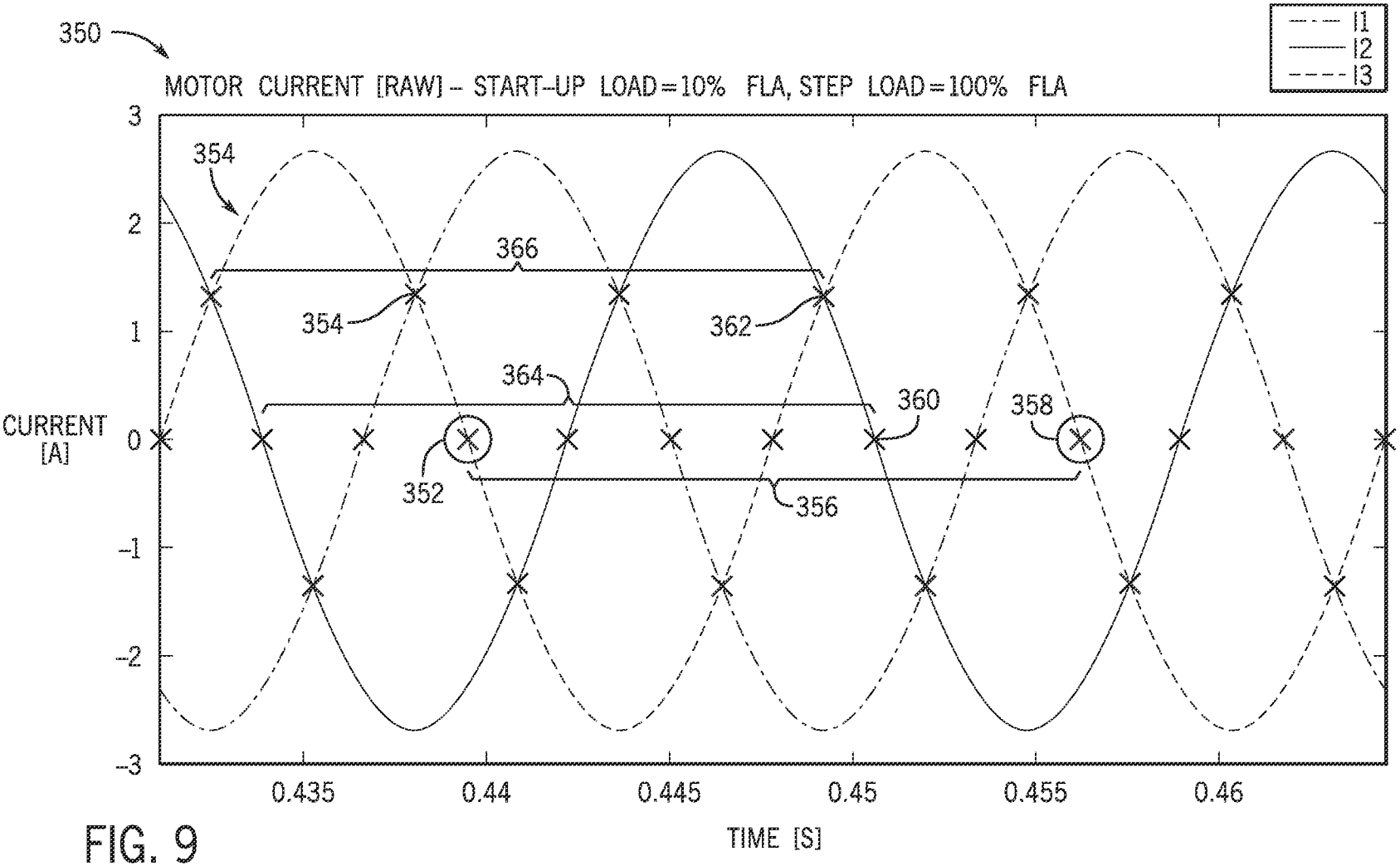
FIG. 9 is a current-time graph that depicts certain features that may be utilized to perform certain steps of the processes described herein, in accordance with an embodiment.

At block 304, the control and monitoring circuitry 18 may receive a command to open the switching device. After the control and monitoring circuitry 18 receives the command to open or break the switching device, the control and monitoring circuitry 18 may select a current zero-crossing point as a synchronization point to determine an expected time of a predicted current zero-crossing point to open or break the switching device at block 306. For example, as illustrated in FIG. 9, the control and monitoring circuity 18 may select the current zero-crossing point 352 as the synchronization point for a respective phase (e.g., the first phase 354). Although the process 300 is described with respect to current zero-crossing point 352 being selected as the synchronization point, it should be understood that the synchronization point may be any suitable current zero-crossing point along the multi-phase signal after receiving the command to open or break the switching device.

After selecting the current zero-crossing point 352 as the synchronization point at block 306, the control and monitoring circuity 18 may determine an expected timing of a predcited current zero-crossing point at block 308. In particular, the control and monitoring circuitry 18 may add a period measurement associated with the most recent current zero-crossing point or the most recent current line-to-line crossing point to the synchronization point to determine the expected timing of the predicted current zero-crossing point. For instance, the predicted current zero-crossing point may indicate the timing at which to open or break the switching device to minimize a magnitude and/or duration of arcing when opening or breaking the switching device. For example, as illustrated in FIG. 9, current line-to-line crossing data point 354 is the most recent current line-to-line crossing data point before the selected synchronization data point 352. The control and monitoring circuitry 18 may retrieve the period measurement associated with the current line-to-line crossing data point 354 and add the period measurement to the synchronization point 352 to determine the expected timing of the predicted current zero-crossing (e.g., at data point 358). For instance, an expected period 356 between the synchronization point 352 and the expected timing of the predicted current zero-crossing at data point 358 is equivelent to the period measurement associated with the current line-to-line crossing data point 354.

As the control and monitoring circuitry 18 detects an additional period measurement associated with the next current zero-crossing point or the next current line-to-line crossing point along the multi-phase signal (prior to the predicted current zero-crossing point), at block 310, the control and monitoring circuity 18 may update the expected timing of the predicted current zero-crossing based on the additional period measurements at block 308. For example, after the control and monitoring circuitry 18 determines the period measurement 366 associated with the current line-to-line crossing point 362, the control and monitoring circuitry 18 updates the expected timing of the predicted current zero-crossing by adding the period measurement 366 to the synchronization point 352. Additionally, after the control and monitoring circuitry 18 determines the period measurement 364 associated with the current zero-crossing point 360, the control and monitoring circuitry 18 updates the expected timing of the predicted current zero-crossing by adding the period measurement 364 to the synchronization point 352. In this way, the control and monitoring circuitry 18 may continue to update the expected timing of the predicted current zero-crossing based on the period measurements associated with each current zero-crossing point and each current line-to-line crossing point until the predicted current zero-crossing point is reached. For example, as illustrated in FIG. 9, block 310 may be performed by the control and monitoring circuitry 18 for each current zero-crossing point (e.g., data point 360) and/or each current line-to-line crossing point (e.g., data point 362) until the predicted current zero-crossing is reached. As such, the expected period measurement 356 may be optimized or adjusted based on one or more previously determined period measurements (e.g., period measurements 364 and 366) associated with current zero-crossing data points and/or current line-to-line data points to adjust the timing of the predicted current zero-crossing 358 for a respective phase along the multi-phase signal.

At block 312, as soon as or within a threshold amount of time before (e.g., microseconds) the predicted current zero-crossing point 358 is reached, the control and monitoring circuitry 18 may send a command to the switching device to open (e.g., the contact that corresponds to a first phase associated with the switching device). In some embodiments, the control and monitoring circuitry 18 may send the command to the switching device at a suitable time before the timing of the predicted current zero-crossing 358 to account for a possible delay between sending the command to the switching device to open and a time at which the contacts associated with the switching device open.

In certain embodiments, after determining the predicted current zero-crossing for a first contact of the switching device, the control and monitoring circuitry 18 may transmit respective commands to a second contact of the switching device and a third contact of the switching device to open within a particular time period after the expected timing of the predicted current zero-crossing. With the foregoing in mind, FIG. 10 is a flowchart of a process 400 for opening a second contact associated with a second phase of the multi-phase signal and a third contact associated with a third phase of the multi-phase signal after the first contact has been opened. It should be noted that although the process 400 will be described as being performed by the control and monitoring circuitry 18, it should be understood that the process 400 may be performed by any suitable control system or computing device. In addition, although the process 400 is described in a particular order, it should be noted that the process 400 may be performed in any suitable order.

As described above with respect to process 300, the control and monitoring circuitry 18 may determine an expected timing of a predicted current zero-crossing associated with a first phase of the multi-phase signal at which to open or break a first contact of a switching device and send a command to the switching device to open the first contact before or at the predicted current zero-crossing at block 402. After the switching device opens before or at the predicted current zero-crossing, at block 404, the control and monitoring circuitry 18 may transmit one or more commands to the switching device to open the second contact associated with the second phase and the third contact associated with the third phase with a particular time period. In some embodiments, the time period may correspond to less than or equal to ninety degrees along the multi-phase signal from the predicted current zero-crossing, less than or equal to eighty degrees along the multi-phase signal from the predicted current zero-crossing, or the like.

However, under certain operating conditions, the first contact associated with the first phase may open after the current zero-crossing along the multi-phase signal, thereby causing some arcing. For example, if the first contact opens before or at the current zero-crossing, the current detected through the contact may stop after a period of time. However, if the control and monitoring circuitry 18 determines that the current detected through the first contact has reversed, the control and monitoring circuitry 18 may determine that the first contact has not opened or that the first contact has opened after the current zero-crossing. If the respective timings associated with opening the contacts associated with the second phase and/or the third phase are not adjusted, the contacts associated with the second phase and/or the third phase may also open after the respective current zero-crossing points along the multi-phase signal, thereby causing further arcing. Accordingly, in certain embodiments, if the control and monitoring circuitry 18 determines that a reversal of current through the first contact is present after the first contact has opened, the control and monitoring circuit 18 may adjust the respective timings for opening the contacts associated with the second phase and/or third phase to minimize the magnitude and/or duration of further arcing.

With the foregoing in mind, FIG. 11 is a flowchart of a process 450 for determining whether a reversal of current is present after the first contact associated with the first phase has opened and determining a corresponding time to open the second contact associated with the second phase and the third contact associated with the third phase to minimize the magnitude and/or the duration of arcing when opening the second contact and the third contact. It should be noted that although the process 450 will be described as being performed by the control and monitoring circuitry 18, it should be understood that the process 450 may be performed by any suitable control system or computing device. In addition, although the process 450 is described in a particular order, it should be noted that the process 450 may be performed in any suitable order.

As described above with respect to process 300, the control and monitoring circuitry 18 may determine a timing of a predicted current zero-crossing associated with a first phase of the multi-phase signal at which to break a first contact of a switching device and send a command to the switching device to open or break the first contact before or at the predicted current zero-crossing at block 452. After the first contact of the switching device has opened, the control and monitoring circuitry 18 may determine whether a reversal in the current through the first contact is present at block 454. For example, the control and monitoring circuitry 18 may receive voltage or current data from the sensors 22 associated with the switching device during a period of time after the first contact of the switching device has opened. If the control and monitoring circuitry 18 determines that a reversal of current through the first contact is present (e.g., the current is indicative of the first contact remaining closed) at block 454, the control and monitoring circuitry 18 may send a command to the switching device to open the second contact and the third contact immediately (e.g., after a first period of time) at block 456. In this way, the control and monitoring circuitry 18 may facilitate opening of the second contact and the third contact before the next respective current zero-crossings associated with the second phase and the third phase, thereby minimizing the magnitude and/or duration of arcing. Alternatively, if the control and monitoring circuitry 18 determines that a reversal of current through the first contact is not present (e.g., the current, or lack thereof, is indicative of the first contact being open) at block 454, the control and monitoring circuitry 18 may send a command to the switching device to open the second contact and the third contact after a second period of time has expired. In certain embodiments, the second period of time may be equal to a portion of the most recent period measurement associated with a current zero-crossing of the multi-phase signal or a current line-to-line crossing of the multi-phase signal divided. However, it should be understood that the second period of time may be any suitable period of time and may be application specific. Additionally, the second period of time may be greater than the first period of time.

In some embodiments, the process 450 may be performed instead of process 400 to open the second contact and the third contact. As mentioned above, if the control and monitoring circuitry 18 determines that the current detected through the first contact has reversed (e.g., instead of the current stopping after a period of time), the the control and monitoring circuitry 18 may determine that the first contact has not opened or that the first contact has opened after the current zero-crossing, thereby causing some arcing. To minimize the magnitude and/or duration of further arcing, the control and monitoring circuitry 18 may perform the process 450 to adjust the respective timings for opening the second contact and the third contact.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

While only certain features of the embodiments detailed above have been illustrated and described herein, many modifications and changes will occur to those skilled in the art. It is, therefore, to be understood that the appended claims are intended to cover all such modifications and changes as fall within the true spirit of the embodiments described herein.

The invention claimed is:

1. A system, comprising:

a switching device, comprising:

one or more armatures configured to move between a first position that electrically couples a first contact to a second contact and a second position that electrically uncouples the first contact from the second contact; and a relay coil configured to receive a voltage configured to magnetize the relay coil, thereby causing the one or more armatures to move from the first position to the second position; and a control system configured to perform operations comprising:

receiving a command to move the one or more armatures from the first position to the second position;

selecting a current zero-crossing point along an electric waveform as a synchronization point, wherein the electric waveform is indicative of a change in current through the through the first contact and the second contact;

determining a predicted current zero-crossing point by adding a period measurement associated with a previously detected current zero-crossing point or a previously detected current line-to-line crossing point in the electric waveform to the synchronization point; and transmitting a command to the switching device to move the one or more armatures from the first position to the second position before or at the predicted current zero-crossing point.

2. The system of claim 1, wherein the control system is configured to perform the operations comprising adjusting the predicted current zero-crossing point based on one or more additional period measurements associated with one or more additional current zero-crossing points after the synchronization point, one or more additional current line-to-line crossing points after the synchronization point, or both.

3. The system of claim 2, wherein the one or more additional current zero-crossing points, the one or more additional current line-to-line crossing points, or both, comprise each current zero-crossing point between the synchronization point and the predicted current zero-crossing point along the electric waveform, each current line-to-line crossing point between the synchronization point and the predicted current zero-crossing point along the electric waveform, or both.

4. The system of claim 1, wherein the control system is configured to perform the operations comprising adjusting the predicted current zero-crossing point by:

adding an updated period measurement associated with an additional current zero crossing point or an additional current line-to-line crossing point to the synchronization point.

5. The system of claim 1, wherein the current zero-crossing point selected as the synchronization point is a subsequent current zero-crossing point along the electric waveform after receiving the command to move the armature.

6. The system of claim 1, wherein the control system is configured to perform the operations comprising receiving sensor data associated with an electric power received by the switching device and generating the electric waveform based on the sensor data.

7. The system of claim 1, wherein the control system is configured to perform the operations comprising continuously determining a plurality of period measurements associated with each current zero-crossing point and each current line-to-line crossing point along the electric waveform, wherein the plurality of period measurements comprises the period measurement associated with the previously detected current zero-crossing point or the previously detected current line-to-line crossing point and the respective period measurements.

8. The system of claim 1, wherein the one or more armatures are associated with a first phase of the electric waveform, and wherein a second armature associated with the switching device is associated with a second phase of the electric waveform and a third armature associated with the switching device is associated with a third phase of the electric waveform, and wherein the control system is configured to perform the operations comprising transmitting a command to the move the second armature, the third armature, or both, from the first position to the second position within a time period associated with the most recently detected current zero crossing or the most recently detected current line-to-line crossing point after the one or more armatures associated with the first phase have moved from the first position to the second position.

9. A non-transitory, computer-readable storage medium, comprising instructions that, when executed by one or more processors, cause the one or more processors to perform operations comprising:

receiving a command to move one or more armatures of a switching device from a first position to a second position, wherein the first position of the one or more armatures electrically couples a first contact to a second contact and the second position of the one or more armatures electrically uncouples the first contact from the second contact;

selecting a current zero-crossing point along an electric waveform as a synchronization point, wherein the electric waveform is indicative of a change in current through the first contact and the second contact;

determining a predicted current zero-crossing point by adding a period measurement associated with a previously detected current zero-crossing point or a previously detected line-to-line crossing point in the electric waveform to the synchronization point; and transmitting a command to the switching device to move the one or more armatures from the first position to the second position before or at the predicted current zero-crossing point.

10. The non-transitory, computer-readable storage medium of claim 9, wherein the operations comprise adjusting the predicted current zero-crossing point by:

adding an updated period measurement associated with an additional current zero crossing point or an additional current line-to-line crossing point to the synchronization point.

11. The non-transitory, computer-readable storage medium of claim 9, wherein transmitting the command to the switching device to move the one or more armatures from the first position to the second position before or at the predicted current zero-crossing point comprises transmitting the command at a time before the predicted current zero-crossing point based on a delay between transmitting the command to the switching device and the one or more armatures moving from the first position to the second position.

12. The non-transitory, computer-readable storage medium of claim 9, wherein the one or more armatures are associated with a first phase of the electric waveform, and wherein a second armature associated with the switching device is associated with a second phase of the electric waveform and a third armature associated with the switching device is associated with a third phase of the electric waveform.

13. The non-transitory, computer-readable storage medium of claim 12, wherein the operations comprise transmitting a command to the move the second armature, the third armature, or both, from the first position to the second position within a time period associated with the most recently detected current zero crossing or the most recently detected current line-to-line crossing point after the one or more armatures associated with the first phase have moved from the first position to the second position.

14. The non-transitory, computer-readable storage medium of claim 12, wherein the operations comprise determining whether a reversal of current through the first contact and the second contact associated with the first phase to open is present after transmitting the command to the switching device to move the one or more armatures associated with the first phase to open from the first position to the second position.

15. The non-transitory, computer-readable storage medium of claim 14, wherein the operations comprise transmitting a command to the switching device to move the second armature, the third armature, or both, within a first time period in response to determining that the reversal of current through the first contact and the second contact associated with the first phase to open is present.

16. The non-transitory, computer-readable storage medium of claim 15, wherein the operations comprise transmitting a command to the switching device to move the second armature, the third armature, or both, within a second time period in response to determining that the reversal of current through the first contact and the second contact associated with the first phase to open is not present.

17. The non-transitory, computer-readable storage medium of claim 16, wherein the second time period is greater than the first time period.

18. A method, comprising:

receiving, via one or more processors, a command to move one or more armatures of a switching device from a first position to a second position, wherein the first position of the one or more armatures electrically couples a first contact to a second contact and the second position of the one or more armatures electrically uncouples the first contact from the second contact;

selecting, via the one or more processors, a current zero-crossing point along an electric waveform as a synchronization point, wherein the electric waveform is indicative of a change in current through the first contact and the second contact;

determining, via the one or more processors, a predicted current zero-crossing point by adding a period measurement associated with a previously detected current zero-crossing point or a previously detected line-to-line crossing point in the electric waveform to the synchronization point; and transmitting, via the one or more processors, a command to the switching device to move the one or more armatures from the first position to the second position before or at the predicted current zero-crossing point.

19. The method of claim 18, wherein the one or more armatures of the switching device are associated with a first phase of the electric waveform, and wherein a second armature of the switching device is associated with a second phase of the electric waveform and a third armature of the switching device is associated with a third phase of the electric waveform.

20. The method of claim 19, comprising:

determining that a reversal of current through the first contact and the second contact associated with the first phase to open is present after transmitting the command to the switching device to move the one or more armatures associated with the first phase to open from the first position to the second position; and transmitting a command to the switching device to move the second armature, the third armature, or both, within a first time period in response to determining that the reversal of current through the first contact and the second contact associated with the first phase to open is present.

* * * * *